United States Patent [19]

Sakurai et al.

[11] Patent Number: 4,953,525

[45] Date of Patent: Sep. 4, 1990

[54] COOLING SYSTEM FOR V TYPE ENGINE

[75] Inventors: Kenichi Sakurai; Yoshihide Takano, both of Iwata, Japan

[73] Assignee: Yamaha Hatsudoki Kabushiki Kaisha, Iwata, Japan

[21] Appl. No.: 414,679

[22] Filed: Sep. 29, 1989

[30] Foreign Application Priority Data

Sep. 30, 1988 [JP] Japan ..... 63-246136

[51] Int. Cl.[5] ..... F02B 75/18

[52] U.S. Cl. ..... 123/41.28; 123/41.1; 123/55 VS; 123/195 R

[58] Field of Search ..... 123/41.08, 41.09, 41.10, 123/41.28, 41.29, 41.44, 41.47, 41.72, 55 VF, 55 VS, 55 VE, 195 R

[56] References Cited

U.S. PATENT DOCUMENTS 1,862,723 6/1932 Summers ..... 123/55 VE 2,936,745 5/1960 Frank ..... 123/41.29

4,745,885 5/1988 Koinuma ..... 123/41.44

FOREIGN PATENT DOCUMENTS 62-85110 4/1987 Japan .

*Primary Examiner*—Noah P. Kamen

*Attorney, Agent, or Firm*—Ernest A. Beutler

[57] ABSTRACT

A cooling system and crankcase ventilating system for a V type internal combustion engine wherein the crankcase ventilating system includes a crankcase ventilating chamber that is positioned in the valley of the V of the engine. The cooling system includes a main coolant gallery that extends through the valley of the engine and is disposed between the crankcase ventilating chamber and the crankcase for cooling the crankcase ventilating gases. The main gallery also partially encircles the main oil gallery for cooling the lubricant.

7 Claims, 12 Drawing Sheets

COOLING SYSTEM FOR V TYPE ENGINE

BACKGROUND OF THE INVENTION

This invention relates to a cooling system for a V type engine and more particularly to an improved cooling arrangement that is particularly adapted for use with V type engines.

As is well known, it is desirable to insure that the individual cylinder barrels of a multiple cylinder engine each receive adequate and equal amounts of coolant so as to avoid temperature variations. This is true with both inline and V type engines. Normally, it has been the practice to provide the coolant pump and thermostat at one end of the engine and this makes it difficult to insure that there is adequate cooling for all of the cylinder banks of the engine. That is, there is a tendency of the cylinder barrels positioned close to the water pump and thermostat to receive a greater amount of coolant than those that are positioned more remotely from the water pump and thermostat.

It is, therefore, a principal object of this invention to provide an improved cooling arrangement for a multiple cylinder engine.

It is a further object of this invention to provide an improved cooling system for a V type engine wherein it is insured that all of the cylinders will receive equal and adequate amounts of coolant.

Normally, with V type engines, the water pump is provided with a pair of branch outlets each of which delivers coolant to the respective cylinder banks. Obviously, such an arrangement involves the introduction of coolant water to the individual cylinder banks at one end thereof and this further aggravates the problem of insuring adequate and equal cooling to each of the cylinder barrels.

It is, therefore, a still further object of this invention to provide an improved cooling system and coolant distribution arrangement for a V type engine.

In automotive applications, frequently the engine is positioned so that it extends transversely in the engine compartment. As a result, the placement of the water pump and thermostat at one end of the engine may not be most appropriate in all applications where the engine is transversely positioned within the engine compartment. In order to provide a better relationship between these components of the engine and the associated radiator, which extends transversely to the engine, it has been proposed to place the thermostat at one end of the engine and the water pump at the other end. Such an arrangement is shown in copending Application Ser. No. 261,719, entitled "Crankcase Vent System", filed Oct. 24, 1988 in the name of Kenichi Sakurai et al, which application is a continuation of Application Ser. No. 914,869, filed Oct. 3, 1986, which applications are assigned to the assignee of this application. Although such placement of the thermostat and water pump have significant advantages, particularly in connection with transverse engine placement, it is still necessary to insure adequate cooling for all of the cylinders and equal cooling therefor.

It is, therefore, a still further object of this invention to provide an improved cooling system for a transversely positioned V type engine.

SUMMARY OF THE INVENTION

This invention is adapted to be embodied in a cooling system for an internal combustion engine having a cylinder block with angularly disposed banks forming respective cylinder bores. The cylinder banks define a valley therebetween and a coolant manifold passage is formed in the cylinder block at the base of the valley. Coolant delivery passages formed in the cylinder block communicate the coolant manifold passage with cooling jackets that surround the cylinder bores.

DETAILED DESCRIPTION OF THE PREFERRED EMBODIMENT

Figure 1:
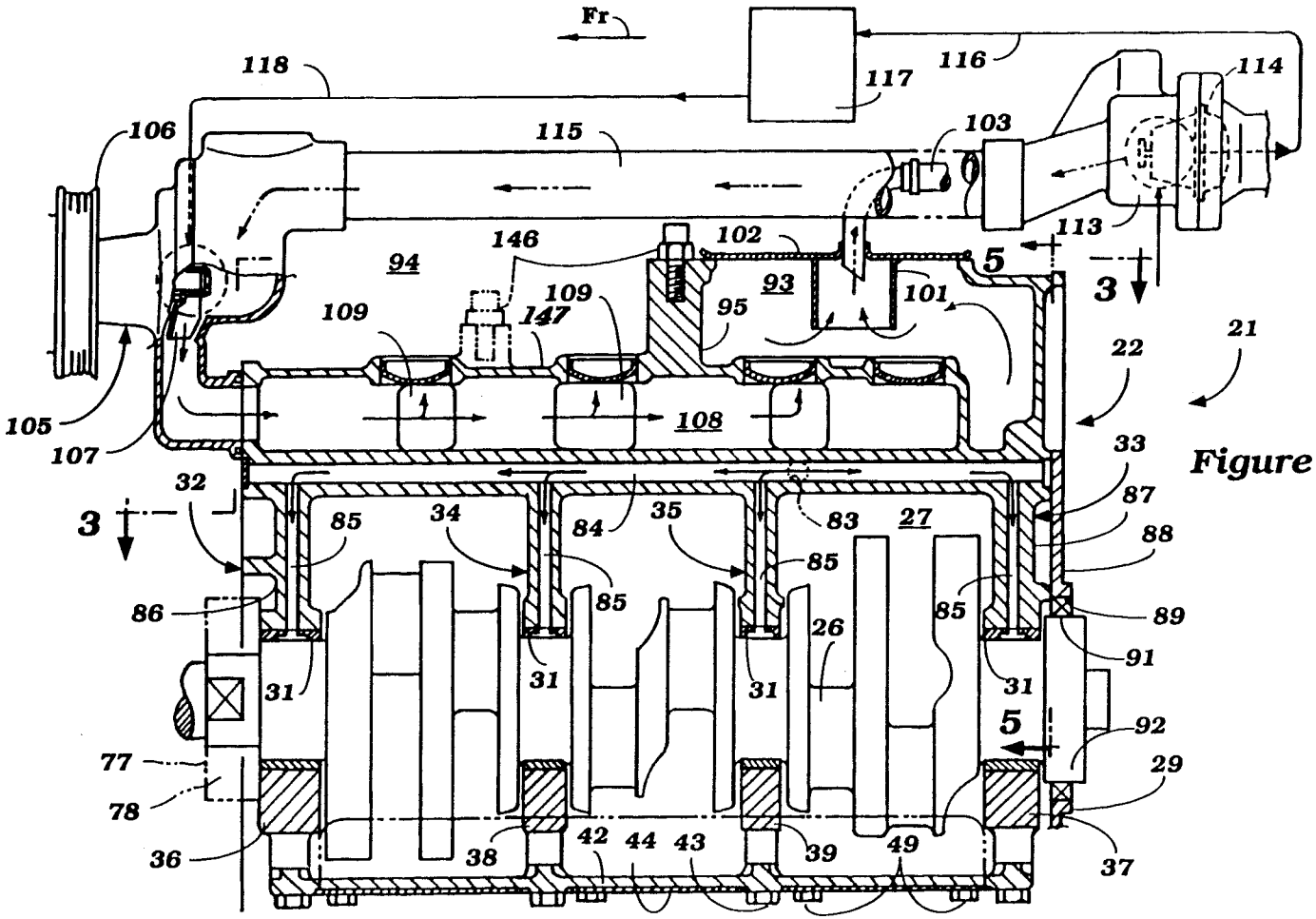
FIG. 1 is a cross-sectional view taken through a V type engine having a crankcase ventilating system constructed in accordance with an embodiment of the invention and is taken generally along the line 1—1 of FIG. 2.

An internal combustion engine constructed in accordance with an embodiment of the invention is identified generally by the reference numeral 21. In the illustrated embodiment, the engine 21 is of the automotive type and is designed so as to be positioned transversely in the engine compartment of a front engine, front wheel driven car. Such an installation is only typical of the environments in which the invention can be practiced. Even though the engine is disposed transversely, one end of the engine is identified as the front and the other end is identified as the rear. The front of the engine is identified by the arrow Fr in certain of the figures and as is conventional in transverse engine placement, the left hand side of the engine is considered to be the front side of the engine.

The engine 21 includes a cylinder block, indicated generally by the reference numeral 22 which, in the illustrated embodiment, is of the V6 type. It is to be understood, however, that the invention can be utilized in conjunction with engines having other numbers of cylinders or other cylinder configurations. The invention has particularly utility, however, in connection with V type engines for reasons which will become apparent.

The cylinder block 22 is formed with inclined cylinder banks 23 and 24 that are angularly related to each other and each of which is formed with three cylinder bores 25. The area between the cylinder banks 23 and 24 is generally referred to as the valley and, as will become apparent, the invention deals at least partially with how that valley of the engine is utilized in conjunction with the cooling and crankcase ventilating system.

Figure 3:
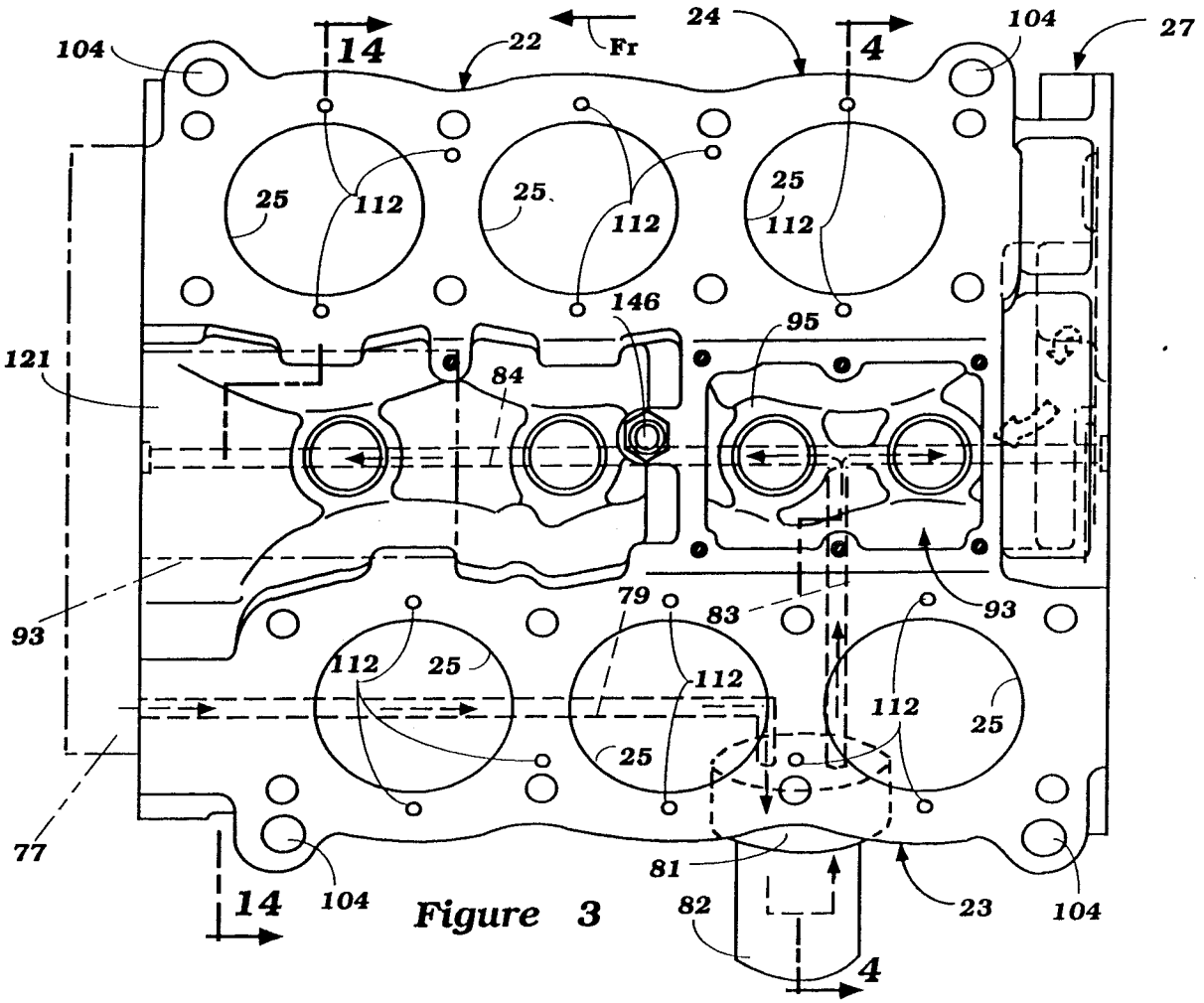
FIG. 3 is a top plan view of the engine with the cylinder heads and intake manifold removed and is taken generally along the line 3—3 of FIG. 1.

As may be best seen in FIG. 3, the cylinder bores 25 of the banks 23 and 24 are staggered with respect to each other so that the connecting rods (not shown) associated with the pistons (also not shown) of the individual cylinder bores 25 may be journaled on the same throws of a crankshaft, indicated generally by the reference numeral 26. This staggering concept is well known in V type engines and, for that reason, further description of it is not believed to be necessary.

The crankshaft 26 is rotatably journaled within a crankcase chamber 27 that is formed beneath the cylinder block 22 and in part by a skirt portion 28 of the cylinder block 22. The crankcase chamber 27 is further closed by means of an oil pan 29 that is affixed to the underside of the cylinder block skirt 28 in a known manner.

Figure 4:
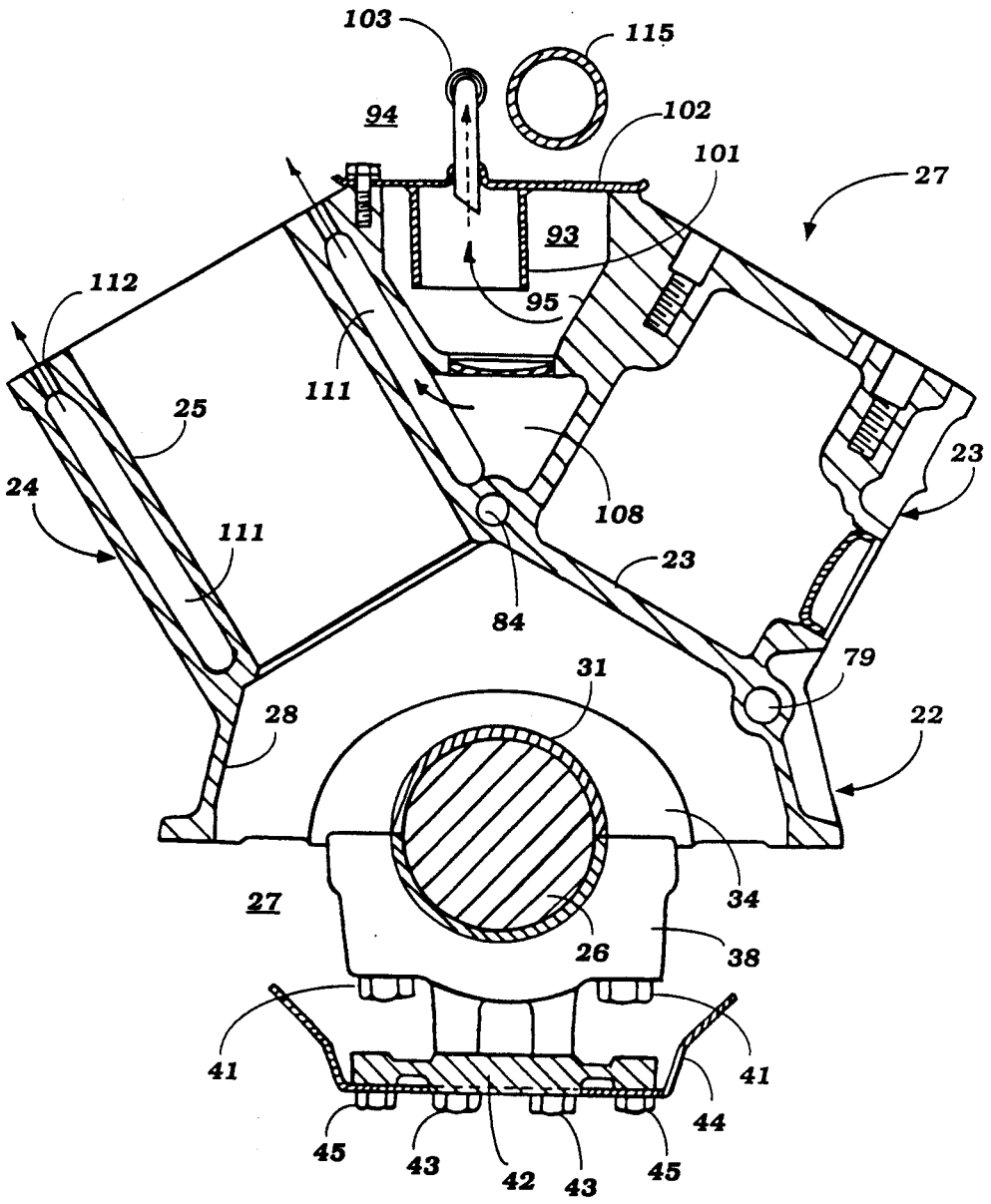
FIG. 4 is a cross-sectional view taken along the line 4—4 of FIG. 3.

The crankshaft 26 is journaled for rotation by means of a plurality of spaced main bearings 31. In the illustrated embodiment, there are provided four main bearings 31. These main bearings 31 are held between front and rear walls 32 and 33 and intermediate webs 34 and 35 formed in the crankcase portion of the cylinder block: 22. Front and rear main bearing caps 36 and 37 are connected to the cylinder block front and rear walls 32 and 33 and intermediate main bearing caps 38 and 39 are affixed to the webs 34 and 35. The fasteners for the main bearing caps appear at 41 in FIG. 4.

The main bearing caps 36, 37, 38 and 39 are all connected to each other by means of a rigidifying member 42 that is affixed to the respective bearing caps by threaded fasteners 43 to provide more structural rigidity for the cylinder block 22 and engine assembly 21. An oil baffle 44 is affixed to the member 42 by further threaded fasteners 45 so as to control the oil within the crankcase chamber 27.

Affixed to the cylinder banks 23 and 24 are respective cylinder heads 46 and 47. The cylinder heads 46 and 47 define with the cylinder bores 25 and the pistons the combustion chambers. There are provided intake valves and exhaust valves in the cylinder heads 46 and 47 and respective ports that serve the combustion chamber. Since this construction may be considered to be conventional, it has not been illustrated.

However, it should be noted that, in the illustrated embodiment, the engine 21 is of the four valve per cylinder type and includes two intake valves for each cylinder and two exhaust valves for each cylinder. The intake valves each are served by respective pairs of intake ports that open through a horizontally disposed wall of the cylinder head assemblies. One of these ports appears and is identified by the reference numeral 48 in FIG. 2. These intake ports are served by an induction system of the type generally described in U.S. Letters Pat. No. 4,649,876, entitled "Intake Means Of Internal Combustion Engine", issued Mar. 17, 1987. Briefly summarized, the induction system, which is indicated generally by the reference numeral 49, is comprised of a pair of plenum chambers 51 and 5 that extend generally along and above the cylinder head assemblies 46 and 47, respectively. At one end of the engine (the rear end in the illustrated embodiment) the plenum chambers 51 and 52 are served by a common, generally Y shaped inlet passageway 53 that has a throttle body 54 affixed to its inlet end and in which a flow controlling throttle valve 55 is positioned. Air is delivered to the throttle body 54 from an air cleaner assembly (not shown) in a suitable manner.

At the end of the engine opposite to that at which the throttle body 54 is positioned, the plenum chambers 51 and 52 are further connected by means of a flow transmitting passageway 56 that improves the volumetric efficiency of the engine as described in U.S. Letters Pat. No. 4,766,853, entitled "Intake Passage For Multi Cylinder Engine", issued Aug. 30, 1988. An intake manifold assembly, indicated generally by the reference numeral 57, is provided for delivering an intake charge from the plenum chambers 51 and 52 to the intake ports of the cylinder heads 46 and 47. The intake manifold 57 includes generally a first series of short, high speed runners 58 that extend from each plenum chamber 51 or 52 to one of the intake ports of each of the cylinder heads 46 and 47 that lie beneath the respective plenum chamber 49 and 51. These short runners 58 are tuned so as to provide good running under high speed conditions. These high speed runners 58 extend from inlet trumpets 59 that extend into the respective plenum chamber 51 or 52. A throttle valve mechanism, indicated generally by the reference numeral 61, and which is comprised of individual throttle valve assemblies positioned in the inlet ends of each of the runners 58, is controlled by a progressive throttle linkage or, alternatively, by a load responsive diaphragm motor 62 so that the short runners 58 are normally closed under low and medium range speeds with the runners 58 being opened under high speed conditions so as to provide good efficiency under high speed running.

For improved low speed runing, the manifold 57 is provided with a plurality of low speed intake runners 63 each of which extends from an inlet opening formed in a flange 64 of the manifold 57 that cooperates with one of the plenum chambers 51 and 52 to one intake port of each of the cylinders of the remotely positioned bank. It should be noted that the individual runner pairs 63 and 58 that serve the respective cylinders terminate in flange ends 65 that afford a means of attachment to the respective cylinder head 46 or 47 adjacent its intake ports.

Certain of the manifold flanges, such as the flanges 64, may be formed with recess portions 66 so as to afford access to threaded fasteners so as to permit attachment. Also, the throttle valve assembly 61 is provided with flanged portions 67 so as to facilitate attachment to the respective plenum chambers 51 or 52.

It should be noted that the intake and exhaust valves of the engine 21 are operated by overhead mounted camshafts (not shown) that are driven in a suitable manner, for example, the manner as described in U.S. Letters Pat. No. 4,643,143, entitled "Valve Driving Means For V Type Engine Of Vehicle", issued Feb. 17, 1987. Reference may be had to that patent for the manner in which the camshafts may be driven.

Figure 9:
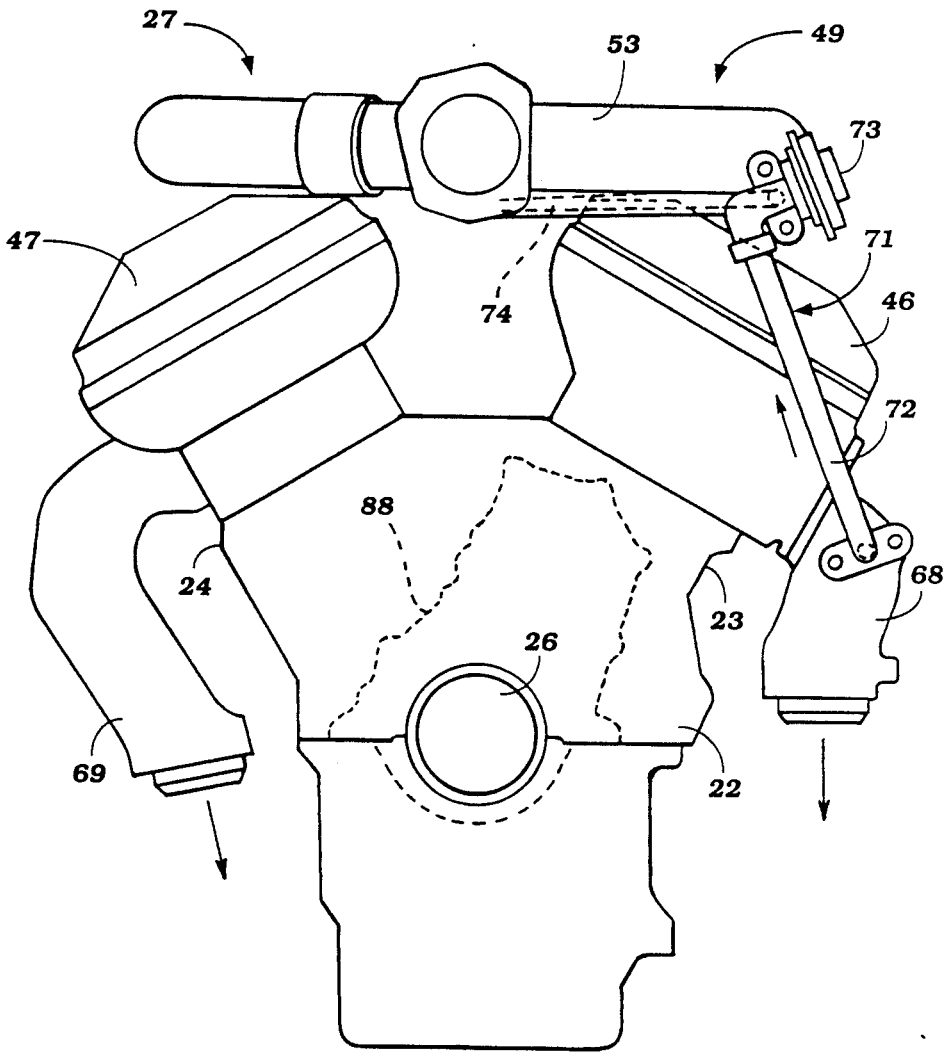
FIG. 9 is an rear end elevational view taken in the direction of the line 9—9 of FIG. 7.

In addition to the intake system 49, the engine 21 is also provided with an exhaust system that includes a pair of exhaust manifolds 68 and 69 that are affixed to the cYlinder head assemblies 46 and 47, respectively (FIG. 9), and which cooperate with their exhaust ports. The manifolds 68 and 69 cooperate with a further exhaust system (not shown) which may be of any known type.

Figure 10:
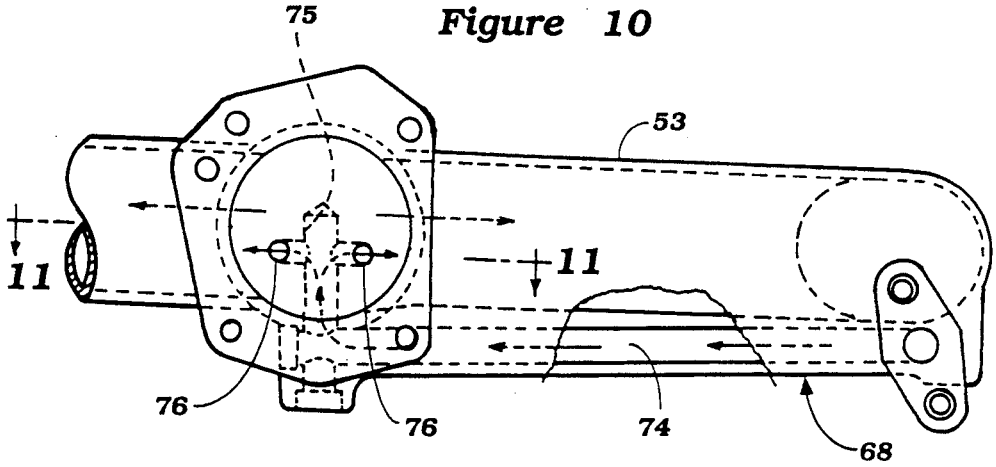
FIG. 10 is a further enlarged front elevational view of a portion of the induction system, with a portion broken away to more clearly show the construction.
Figure 11:
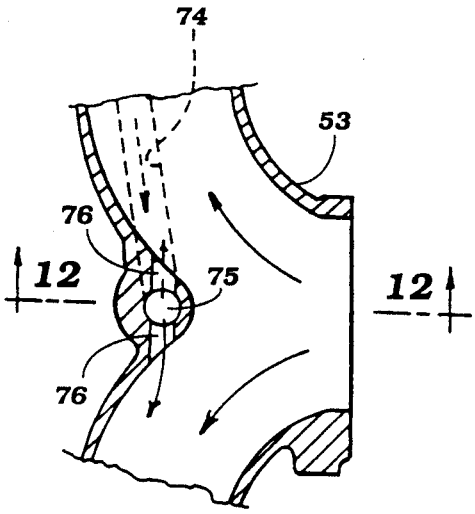
FIG. 11 is a cross-sectional view taken along the line 11—11 of FIG. 10.
Figure 12:
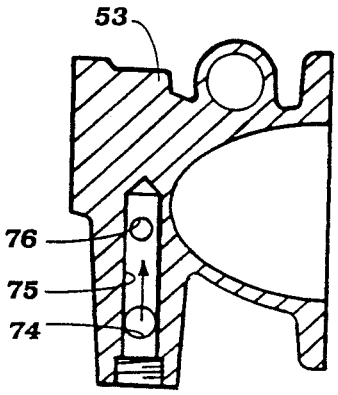
FIG. 12 is a cross-sectional view taken along the line 12—12 of FIG. 11.

The engine 21 is also provided with an exhaust gas recirculation system (EGR) indicated generally by the reference numeral 71 that series to reduce the emission of NOx constituents to the atmosphere. This EGR system 71 includes a conduit 72 that extends from a port in one of the manifolds (in this instance the manifold 68) to an EGR valve 73 that is operated in accordance with any desired type of strategy. The EGR valve 73 operates when opened to recirculate exhaust gases back into the induction system through an internal passageway 74 that is formed in the inlet section 53 of the induction system 49. As may be best seen in FIGS. 10 through 12, the manifold passageway 74 terminates at a cross-drilled passageway 75 that is also cross-drilled as at 76 so as to provide a pair of outlet ports that open into each of the branches of the inlet section 53 so as to equally distribute the exhaust gases being recirculated to the plenum chambers 51 and 52.

Figure 2:
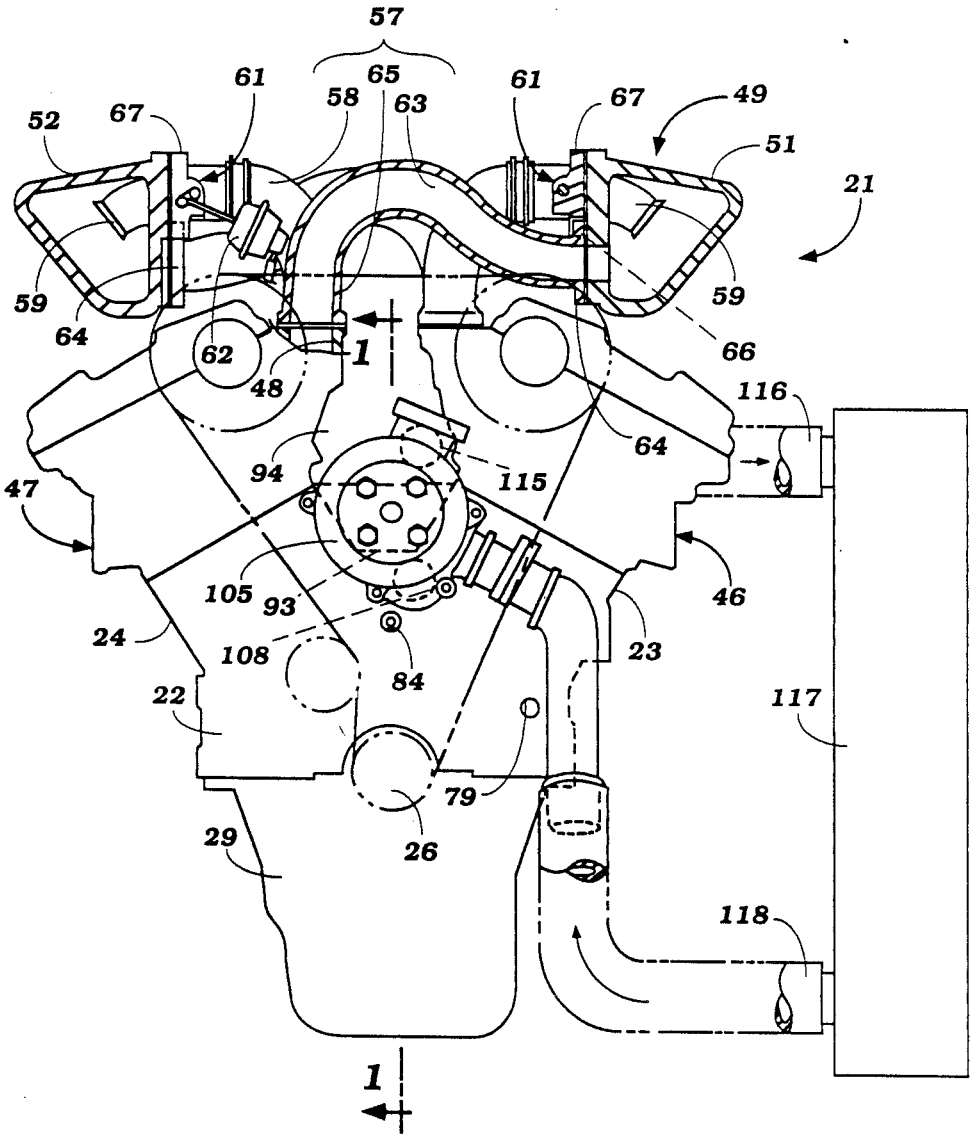
FIG. 2 is a front elevational view of the engine looking generally in the direction of the arrow 2 in FIG. 1, with portions broken away.

The engine 21 is also provided with a lubricating system which is shown partially in FIGS. 1 through 3 of the drawings and which includes a lubricant pump, indicated generally by the reference numeral 77 and shown only schematically. The lubricant pump 77 includes an impeller or pumping element 78 that is driven off the forward end of the crankshaft 26 in a known manner. The lubricant pump 77 discharges its output through a pressure passage 79 that extends through one side of the cylinder block 22 and which communicates with an inlet port formed in an oil filter mount 81. An oil filter 82 is carried on the mount 81 and filters the oil delivered from the passage 79. If desired, the filter mount 81 may also be provided with a cooling jacket so as to cool the circulated lubricant.

The oil is discharged from the oil filter 82 through the mount 81 into a cylinder block passage 83 that intersects a main oil gallery 84 that extends along the length of the cylinder block 22 and specifically at the base of the valley of the V, for a reason which will be described. A plurality of delivery passages 85 which are formed in the cylinder block end walls 32 and 33 and specifically web portions 86 and 87 thereof and through the webs 34 and 35 serve to lubricate the main bearings 31. Lubricant is also delivered to various other components of the engine to be lubricated in any suitable manner.

A blanking plate 88 is appropriately affixed to the rear face of the cylinder block 22 and is formed with a cylindrical recess 89 in which an oil seal 91 is supported. The oil seal 91 engages a surface 92 formed on the crankshaft 26 so as to provide a rear main seal.

A system is provided for circulating ventilating air through the crankcase 27 of the engine, this air being derived primarily from blow by air and for returning it to the atmosphere after passing through the combustion chambers of the engine. This crankcase ventilating system includes a ventilating chamber 93 that extends in the valley 94 between the cylinder banks 23 and 24. The chamber 93 is formed at the rear end of the engine and specifically of the cylinder block 23 and is defined by an upstanding wall 95 of the cylinder block 23. The crankcase ventilating gases from the crankcase 27 are transferred to the chamber 93 by means of a plurality of inlet openings 96 formed in the web 87 and which communicate with a passageway 97 formed by a recessed area 98 of the rear wall of the cylinder block 23 which is closed b the blanking plate 88. It should be noted that the passageway 97 is offset to the side of the cylinder bank 24 in the area formed by the stagger between the cylinder banks so a to permit the flow of crankcase ventilating gases in this area without elongation of the cylinder block 22 or engine 21.

Figure 5:
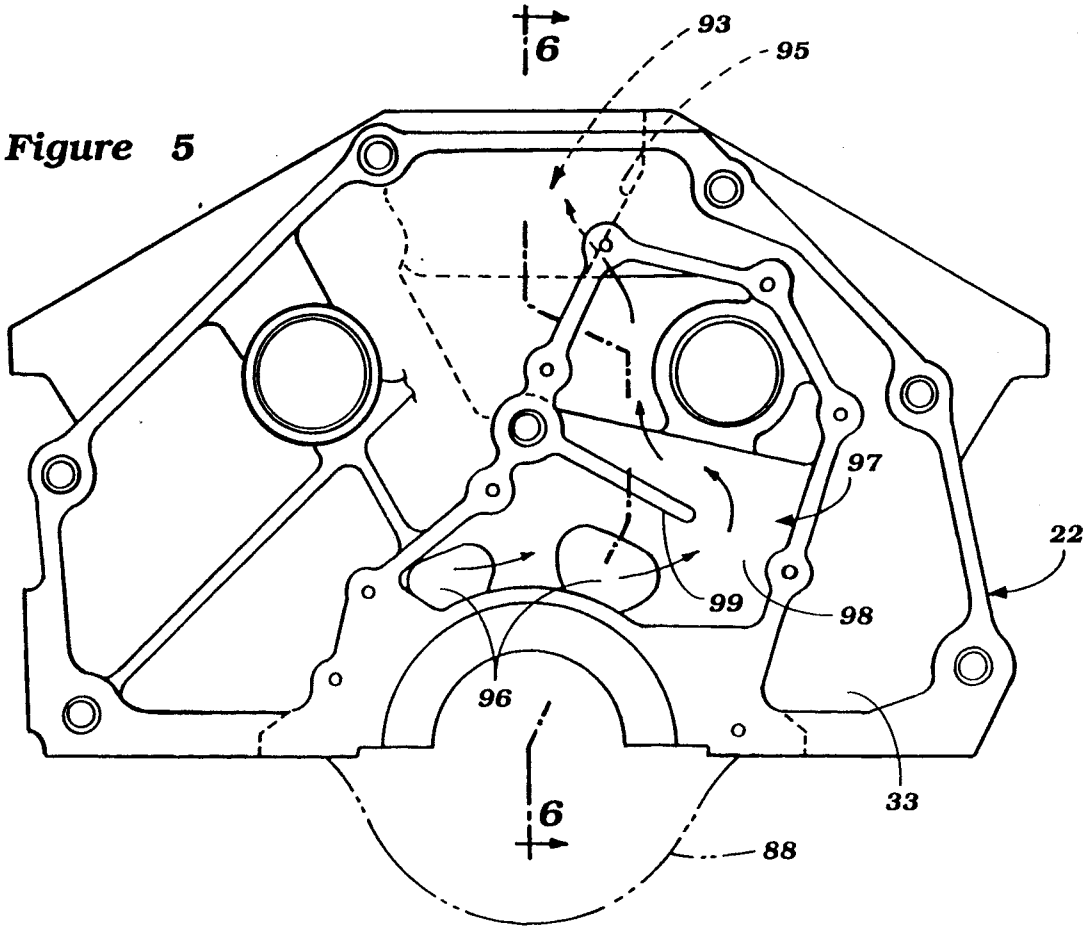
FIG. 5 is a view showing the rear face of the cylinder block with other components removed and is taken generally along the line 5—5 of FIG. 1.
Figure 6:
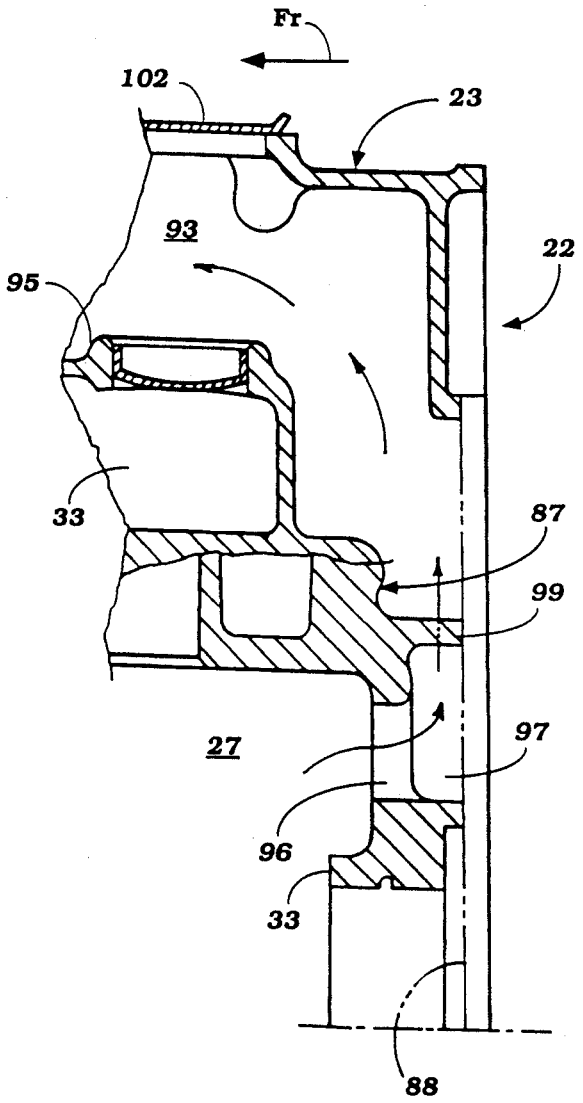
FIG. 6 is a partial cross-sectional view taken along the line 6—6 of FIG. 5.
Figure 7:
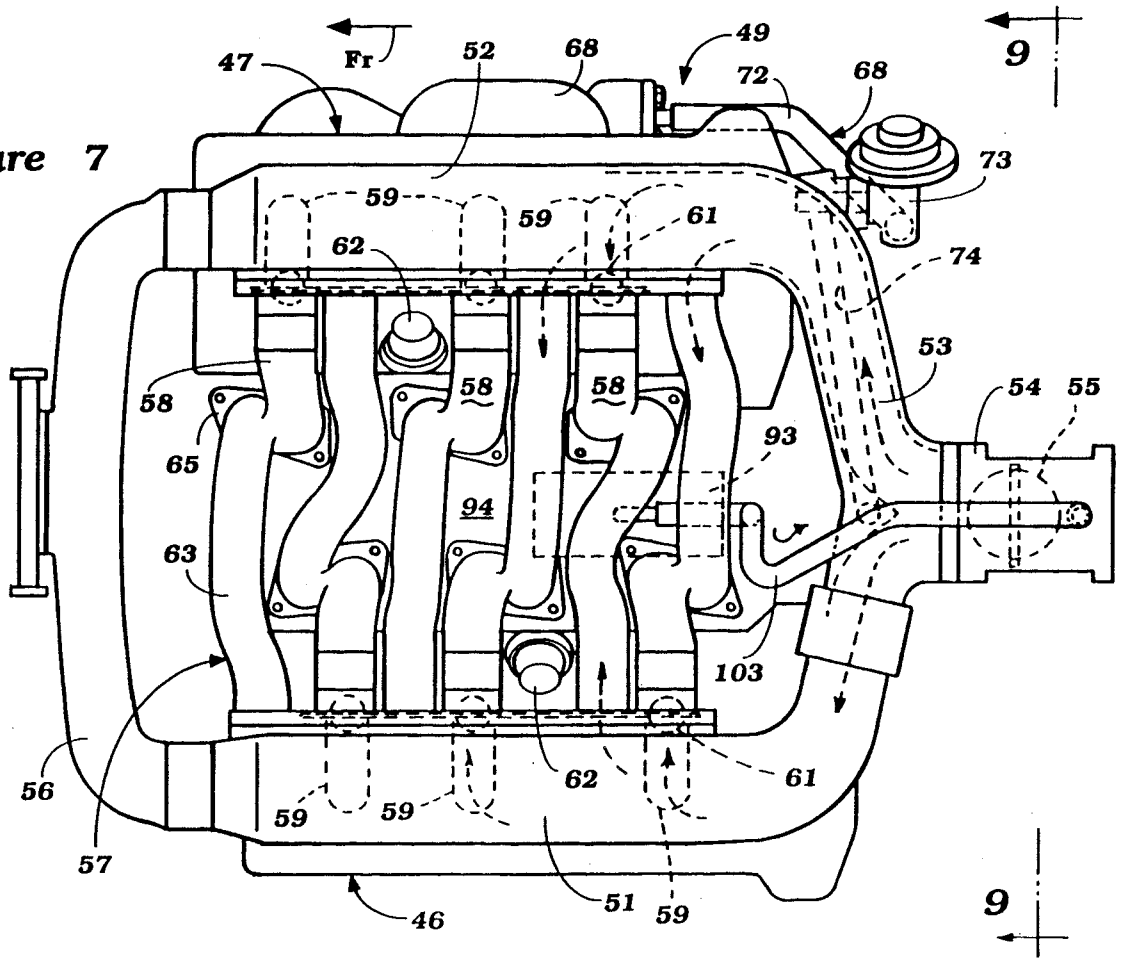
FIG. 7 is a top plan view of the engine.
Figure 8:
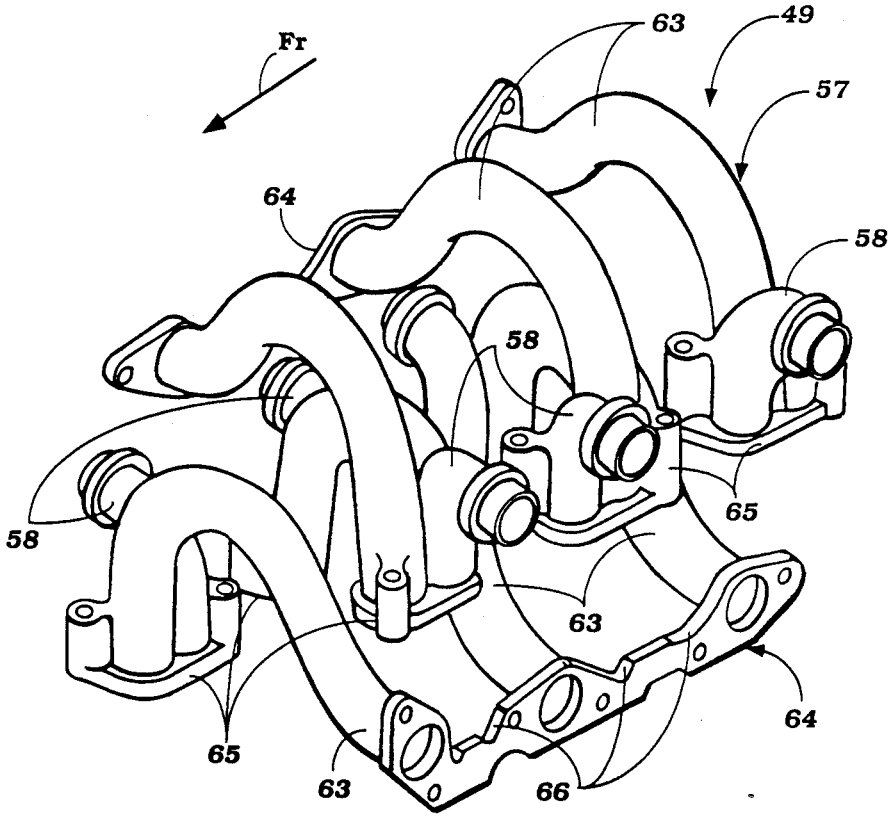
FIG. 8 is a perspective view showing the intake manifold system of the engine.

The rear face of the cylinder block 22 is formed with an outwardly extending rib 99 (FIG. 5) that forms a circuitous path to the passageway 97 so as to assist in the separation of lubricant from the crankcase ventilating gases. In addition, there is provided a separator unit 101 that is fixed to a plate 102 that spans the upper side of the cavity 93 and forms a closure for it. A flexible conduit 102 conveys the crankcase ventilating gases from the chamber 93 to the induction system for reintroduction into the engine and to burn any hydrocarbons contained within the crankcase ventilating gases before their admission to the atmosphere. The conduit 102 extends to an inlet opening that is formed in the throttle body 54 upstream of the throttle valve 55 but downstream of the air inlet device (not shown) so as to insure against any admission of these gases directly to the atmosphere.

The lubricating system for the engine 21, in addition to the passages alreadY described, also includes a mechanism for lubricating the valve train contained within the cylinder heads 46 and 47. Lubricant is returned to the crankcase 29 from the cylinder head assemblies through drain passages 104 (FIG. 3) formed in the cylinder block 22.

The engine 21 is also provided with a liquid cooling system that includes a water pump 105 that is driven at the forward end of the engine by a belt (not shown) that drives a pulley 106 from the crankshaft 26 in a known manner. An impeller 107 is affixed to the shaft driven by the pulley 106 and discharges water into a main cooling gallery 108 that extends longitudinally along the length of the engine 21 at the base of the valley 94 and in proximity to the main oil gallery 84 and also underlying the cavity 93 of the crankcase ventilating system. Because of the interposition of the coolant gallery 104 between &:he crankcase chamber 27 and the crankcase ventilating chamber 93, the crankcase gases will be cooled and any oil contained in them will tend to condense or form into larger particles that will be easily separated by the separator 101 and returned to the crankcase 29 so as to reduce the amount of oil consumption and also the discharge of oil into the induction system.

A plurality of passages 109 interconnect the main coolant gallery 108 with individual cooling jackets 111 formed around the individual cylinders of the cylinder banks 23 and 24.

Passageways 1 12 formed in the upper decks of the cylinder banks 23 and 24 deliver coolant from the cylinder block to the individual cylinder heads 46 and 47 for circulation through the cooling jackets thereof.

The coolant which has circulated through the cylinder block cooling jackets described and the cylinder head cooling jackets is then returned to a combined water manifold and thermostat housing 113 that is positioned at the rear end of the engine or the end opposite to that of the water pump 105. A thermostatic valve 114 is contained within the housing 113 and when the engine is below its normal operating temperature, the coolant is returned directly to the water pump 105 through a bypass conduit 115 that extends through the valley 94 of the engine. On the other hand, when the engine is at its normal operating temperature, the thermostatic valve 114 opens and coolant is delivered from the thermostat housing 113 through a conduit 116 to one header tank of a cross-flow radiator 117. This coolant then flows through the core of the radiator 117 and is returned to the water pump through a further conduit 118.

Figure 13:
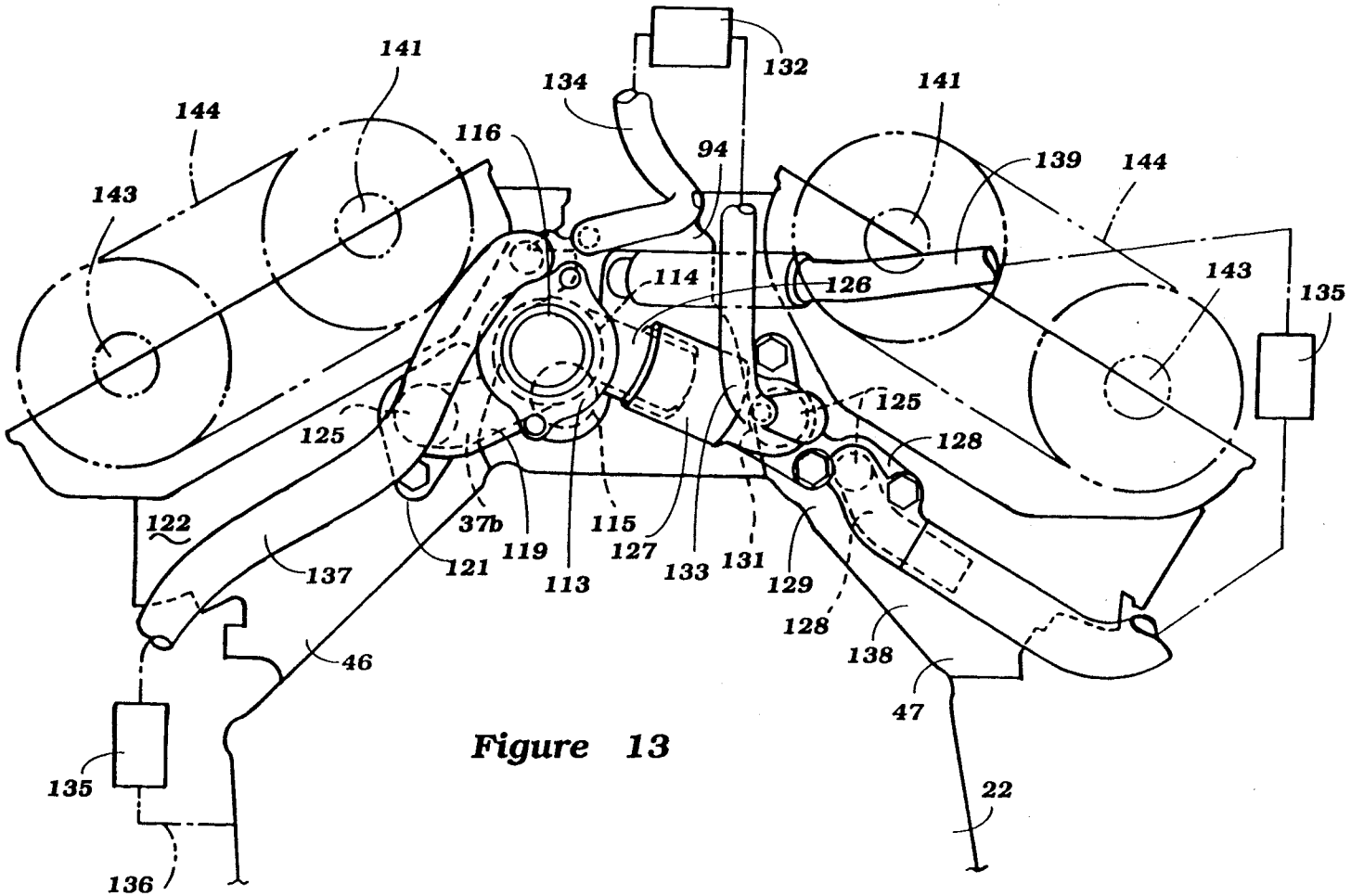
FIG. 13 is an enlarged rear elevational view of the engine.
Figure 14:
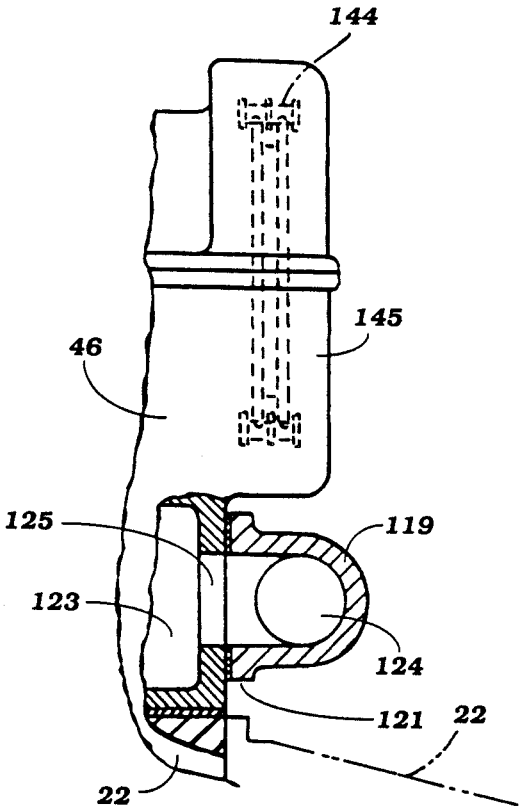
FIG. 14 is a side elevational view of the area of the engine shown in FIG. 13, with a portion broken away.

As may be seen from FIGS. 13 and 14, the manifold thermostat housing 13 has a first branch portion 119 that terminates in a flange 121 that is affixed to a rear face 122 of the cylinder head 46. The cylinder head 46 has its cooling jacket, shown partially at 123, in communication with a passageway 124 formed in the branch 119 via a return port 125.

The housing 113 has a further arm 126 that is connected by means of a flexible conduit 127 to a further fitting 128 that is fixed to a rear face 129 of the cylinder head 47 and which communicates with a coolant return passage 131 formed in this cylinder head.

If desired, the throttle body 55 may be provided with a cooling jacket shown schematically at 132 for providing engine heat to the throttle body 55. The cooling jacket 132 receives coolant from the cylinder head 46 through a conduit 133 that communicates with the fitting 128. This coolant is returned to the thermostat housing downstream of the thermostat 114 through a return conduit 134.

As has been noted, the engine may also be provided with an oil cooler in the base 81 of the oil filter 82. This oil cooler is shown schematically at 135 in FIG. 13, which oil cooler receives coolant from the cylinder block cooling jacket 111 through a flexible conduit 136. This coolant is then returned to the thermostat housing 113 downstream of the thermostatic valve 114 through a flexible conduit 137.

The vehicle is also provided with a heater, shown schematically at 137, and which receives coolant from the cylinder head 47 through a branch conduit 138 of the fitting 128. This coolant is then returned to the thermostat housing 113 downstream of the thermostatic valve 114 by a return conduit 139.

As has been noted, the engine 21 is provided with intake and exhaust camshafts for each of the cylinder head assemblies 46 and 47 and these camshafts may be seen partially in FIGS. 2, 13 and 14 and are driven by means of a camshaft drive arrangement of the type shown in U.S. Letters Pat. 4,643,143. That is, the intake camshafts 141 are driven at one end of the engine (the forward end) by means of a flexible belt 142 that is driven directly from the crankshaft 26. The exhaust camshafts 143 on each cylinder head assembly 46 and 47 ar driven at the opposite end of the engine from the respective intake camshafts by means of a chain 144. As may be seen readily from FIG. 14, the manifold and thermostat housing 113 is conveniently nested beneath respective chain towers 145 of the cylinder head assemblies so as to afford a compact configuration. It should be noted that in this embodiment, driving chains 144 drive the exhaust camshafts. However, the invention is equally susceptible of use with flexible transmitter drives as noted in the aforementioned United States Letters Patent.

A knock sensor 146 may be mounted on the wall 95 as shown in FIGS. 1 and 3 for controlling the ignition to prevent knocking in a known manner. Alternatively, the knock sensor 146 may be positioned on the upper wall 147 of the cylinder block 22 as shown in the phantom line view in FIG. 1.

From the foregoing description, it should be readily apparent that the described engine cooling system is extremely compact and yet insures that all cylinders of the engine will receive adequate and equal cooling. It is also to be understood that the foregoing description is that of a preferred embodiment of the invention and that various changes and modifications may be made without departing from the spirit and scope of the invention, as defined by the appended claims.

We claim:

1. A cooling system for an internal combustion engine having a cylinder block with angularly disposed banks forming respective cylinder bores, said cylinder banks defining a valley therebetween, a coolant manifold passage formed in said cylinder block at the base cf said valley, cooling delivery passages formed in said cylinder block for communicating said coolant manifold passage with cooling jackets surrounding said cylinder bores.

2. A cooling system as set forth in claim 1 further including a coolant inlet to the coolant manifold passage formed at one end of the engine.

3. A cooling system as set forth in claim 1 further including a coolant outlet passage formed at one end of the engine and communicating with the cooling jackets of the respective cylinder banks.

4. A cooling system as set forth in claim 3 further including a coolant inlet at the other end of the engine for delivering coolant to the coolant manifold passage.

5. A cooling system as set forth in claim 4 further including a thermostat communicating directly with the coolant outlet.

6. A cooling system as set forth in claim 5 further including a bypass passageway extending from the thermostat through the valley of the engine back to the coolant inlet at the other end of the engine.

7. A cooling system as set forth in claim 6 further including a coolant pump driven by the engine and located at the other end of the engine.

* * * * *